US005660534A

United States Patent [19]

Snow

[11] Patent Number: 5,660,534

[45] Date of Patent: Aug. 26, 1997

[54] ROTATING PLUNGER FOR SUCKER ROD PUMP

[76] Inventor: Jerry M. Snow, 2545 Adelaide Rd., Paso Robles, Calif. 93446

[21] Appl. No.: 655,454

[22] Filed: May 30, 1996

Related U.S. Application Data

[63] Continuation-in-part of Ser. No. 550,018, Oct. 30, 1995, abandoned.

[51] Int. Cl.[6] ..... F01B 31/00

[52] U.S. Cl. ..... 417/554; 92/173

[58] Field of Search ..... 417/455, 554, 417/555.2; 92/173

[56] References Cited

U.S. PATENT DOCUMENTS

| | | | |
|---|---|---|---|
| 627,039 | 6/1899 | Youmans | 92/173 |
| 1,026,873 | 5/1912 | Locke | 92/173 |
| 1,201,543 | 10/1916 | Becker | 92/173 |
| 1,275,546 | 8/1918 | Fleming | 92/173 |

*Primary Examiner*—Timothy Thorpe
*Assistant Examiner*—Roland G. McAndrews, Jr.
*Attorney, Agent, or Firm*—Daniel C. McKown

[57] ABSTRACT

A downhole sucker rod pump especially well adapted for use in pumping thick oils and oils containing particles of sand or rock includes helical grooves or apertures for producing an intermittent unidirectional rotation of the plunger without appreciably restricting the flow of oil through the pump. This rotation distributes wear more uniformly around the plunger. In a first embodiment, helical apertures are provided in the cage portion at the upper end of the plunger. Because of their large axial extent, these apertures collectively provide an outlet of large area for the oil, and thus restrict the flow only slightly. Because of their inclination these apertures produce a torque on the cage and plunger. In a second embodiment, a second plunger is attached to the upper end of the cage. The second plunger includes helical grooves in its cylindrical outer surface. The lower portion of the cage is provided with apertures that permit the oil to flow from the interior of the cage into a space between the cage and the pump barrel, this space being closed at its upper end by the second plunger. To continue its upward movement, the oil must flow through the helical grooves of the second plunger, thereby imparting a torque to the cage. As in the first embodiment, a swivel connection is provided to permit rotation of the cage and plunger with respect to the pull rod.

3 Claims, 3 Drawing Sheets

ROTATING PLUNGER FOR SUCKER ROD PUMP

RELATED APPLICATIONS

The present application is a continuation-in-part of application Ser. No. 08/550,018 filed Oct. 30, 1995 for "Rotating Piston for Sucker Rod Pump" by the present inventor, now abandoned. Priority from Oct. 30, 1995 is claimed for subject matter common to the prior and present applications.

BACKGROUND OF THE INVENTION

1. Field of the Invention

The present invention is in the field of pumps for use in pumping oil from an oil well, and more specifically relates to a downhole sucker rod pump that is especially well adapted for pumping thick oils and oils containing particles of rock and sand. In the pump of the present invention the plunger is caused to rotate. This greatly extends the useful life of the pump by promoting even wear and by preventing galling of the plunger, by preventing sand from causing the plunger to become stuck in the barrel, and by helping to prevent the rod string from becoming unscrewed.

2. The Prior Art

Some oil wells initially produce a thin oil; as the well becomes depleted it produces a thicker oil that in many cases contains particles of sand and rock. Other oil wells produce thick sand-containing oil from the beginning.

Such wells are sometimes considered to be of marginal economic value because the product requires special treatment and because the oil is more difficult to produce. Part of the problem is that the sand in the oil is very hard on pumps and replacement of a pump is an expensive operation.

Specifically, the sand causes uneven wear of the plunger of the pump and of the pump barrel. Typically the wear-weakened parts fail and the pump must be pulled from the well and replaced. This expensive operation makes the well less desirable economically, and in many cases production is terminated, even though the well may still contain a sizable amount of usable oil. There are literally hundreds of such wells.

The motivation for the present invention is the idea that if a more robust pump could be devised, many of these uneconomical wells could be brought back into production.

The principle of distributing the wear on a piston more uniformly around its circumference by rotating the piston about the axis of the cylinder is not new. For example, in 1937 in U.S. Pat. No. 2,097,629, Lowrey described a piston having within the lower end a spiraled vane for producing a rotational motion causing the valve to wear uniformly. A somewhat similar piston was patented by Downing in 1894 in U.S. Pat. No. 518,490; uniformity of wear was not mentioned, and the perceived advantage was that the torque produced prevented the piston from becoming unscrewed from the pull rod, which clearly limited rotation of the piston.

What is believed to be new in the present invention is that the desired rotation of the piston is achieved without appreciably restricting the flow of oil through the plunger. This advantage is crucial for pumps intended for use with highly viscous oils and oils containing particles of sand and stone.

As can be seen in the drawings of Lowrey and of Downing, the vane structures they use are positioned at the lower end of the plunger in the oil intake port, and these vane structures severely restrict the flow of oil into the plunger, thereby reducing production, increasing the risk of plugging the flow path, and increasing the likelihood of "pounding" on the downstroke of the plunger.

In U.S. Pat. No. 627,039 Youroans describes a piston for a water pump. The piston includes segments that separate slightly on the downstroke to form passages for the water. Here again the flow path is severely restricted which would be especially disadvantageous if the pump were to be used for thick oil or oil containing sand or rock particles.

Fleming in U.S. Pat. No. 1,275,546 and Adams in U.S. Pat. No. 1,415,911 both show vanes located in the flow path near the lower end of the plunger and restricting the flow path, for the purpose of producing rotation to distribute wear more evenly.

The patents referred to above are all comparatively old, and it is unlikely that the pumps having these designs could survive long enough to be practical when operated at the pumping rates and rod string lengths commonly used today.

From the above discussion of the prior art it is clear that while the principle of rotating the plunger to distribute wear more evenly is well-known, no one has successfully applied that principle to the design of a plunger for a pump intended for use with thick oil and oil containing sand or rock particles, where the even distribution of wear is especially important but where restriction of the flow of oil through the piston must be minimized.

SUMMARY OF THE INVENTION

It is an object of the present invention to provide an improved plunger for use in a pump used for pumping thick oils and oils containing particles of sand or rock.

In accordance with the present invention there is provided a pump especially well adapted for use in pumping thick oils and oils containing particles of rock and sand. The pump includes means for producing an intermittent unidirectional rotation of the plunger, which distributes wear more uniformly around the plunger, without restricting the flow of oil through the pump or weakening the parts of the pump.

In a first embodiment, helical apertures are provided in the cage portion at the upper end of the plunger. Because of their axial extent, these apertures collectively provide an outlet of large cross-sectional area for the oil, and thus restrict the flow of the oil only slightly. Because of their inclination these apertures produce a torque on the cage as the oil is discharged. The cage is connected to the pull rod by a swivel joint that permits rotation of the plunger with respect to the pull rod as the oil is discharged on the downstroke.

In a second embodiment the cage includes at its upper end a piston that includes helical grooves in its cylindrical outer surface and that fits within the pump barrel in a loose sliding fit. The lower portion of the cage is provided with apertures that permit the oil to flow from the interior of the cage into a space between the cage and the pump barrel, the space being closed at its upper end by the piston. To continue its upward movement, the oil must flow through the helical grooves of the piston, thereby imparting a torque to the cage.

As in the first embodiment, a swivel connection between the cage and the pull rod permits rotation of the plunger with respect to the pull rod. The diameter of the piston is slightly less than the diameter of the pump barrel, and therefore is substantially larger than the diameter of the intake port at the bottom of the pump. Several helical grooves are provided, and their combined cross sectional area is substantially larger than the cross sectional area of the intake port of the pump, so that the flow of oil is not appreciably restricted by flowing through the torque-producing helical grooves.

The novel features which are believed to be characteristic of the invention, both as to organization and method of operation, together with further objects and advantages thereof, will be better understood from the following description considered in connection with the accompanying drawings in which two preferred embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
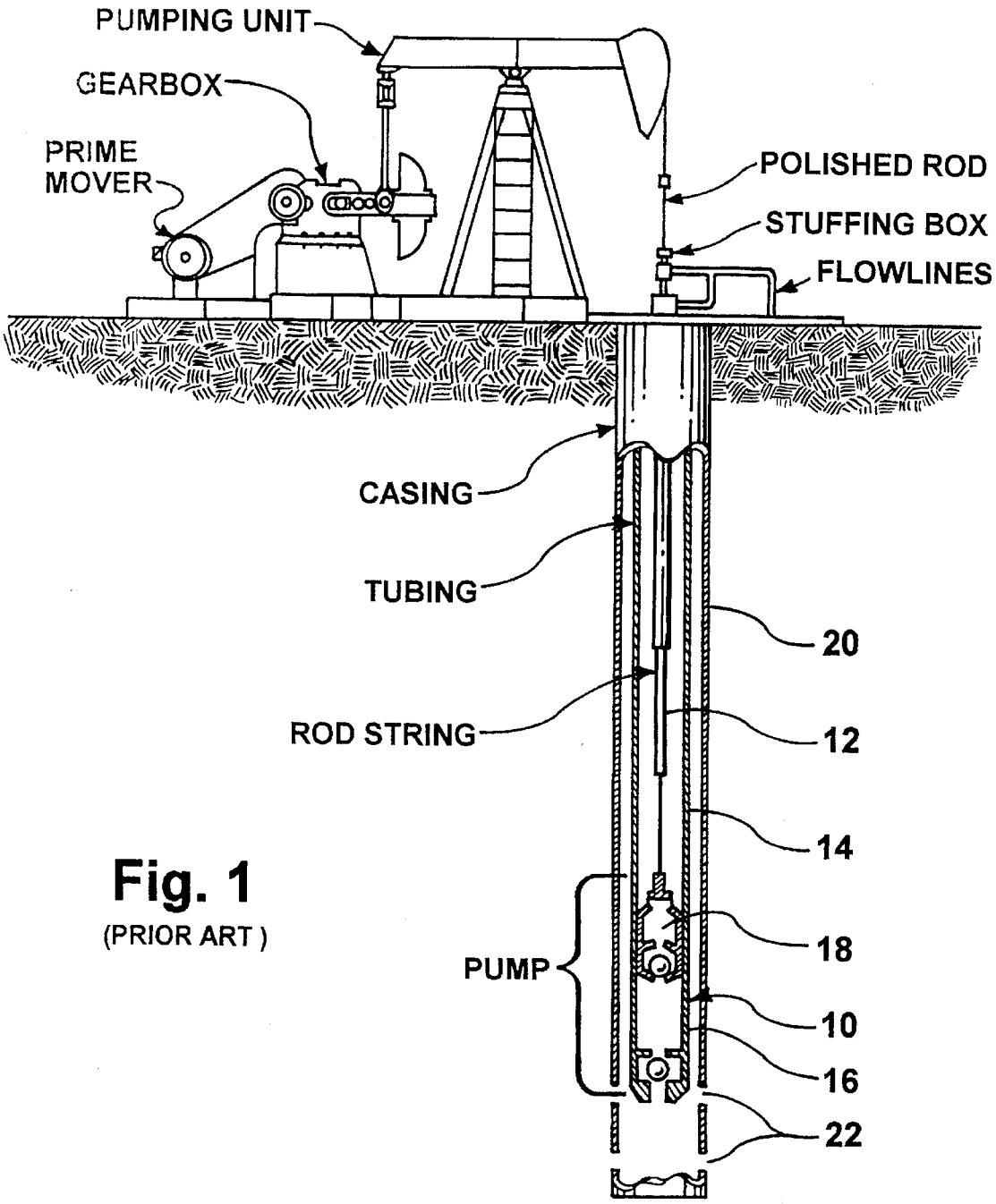
Fig. 1 (PRIOR ART)
FIG. 1 is a diagram showing a side elevational view of a typical rod pumping system of the prior art.
Figure 2:
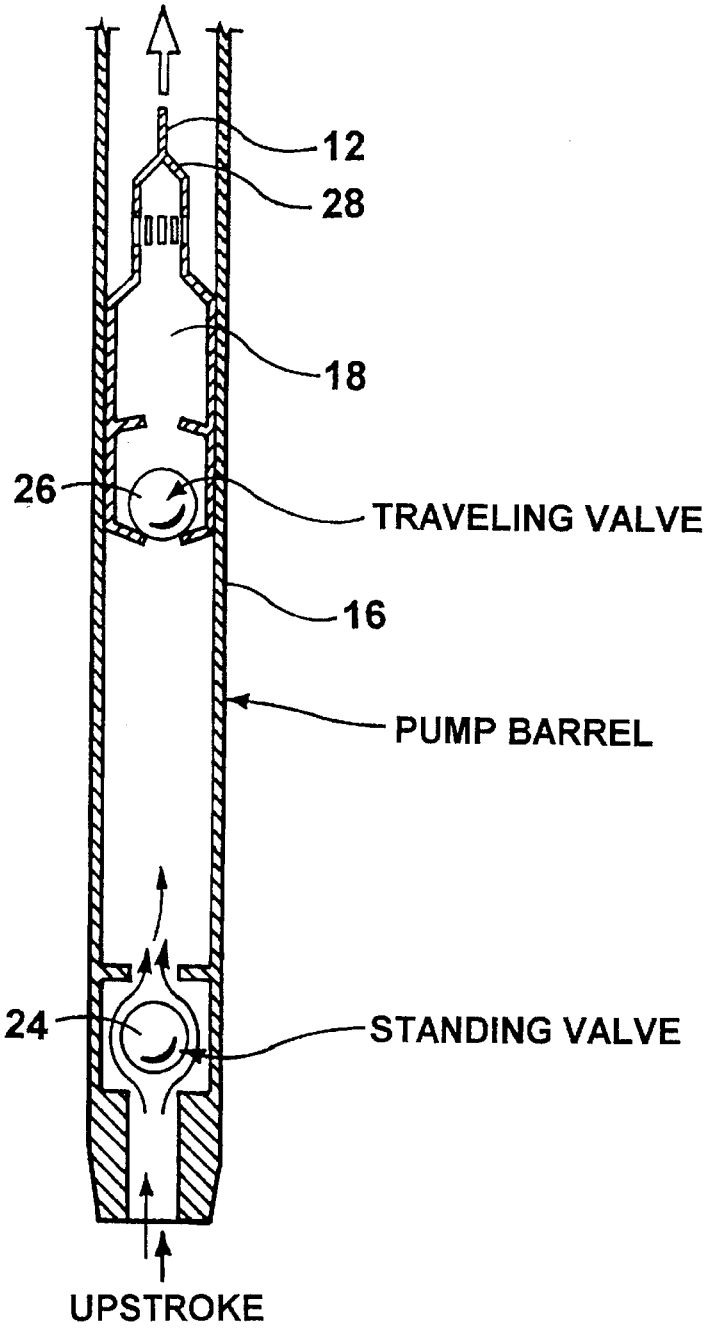
Fig. 2 ( PRIOR ART )
FIG. 2 is a diagram showing a typical sucker rod pump of the prior art during an upstroke phase of its cycle of operation.
Figure 3:
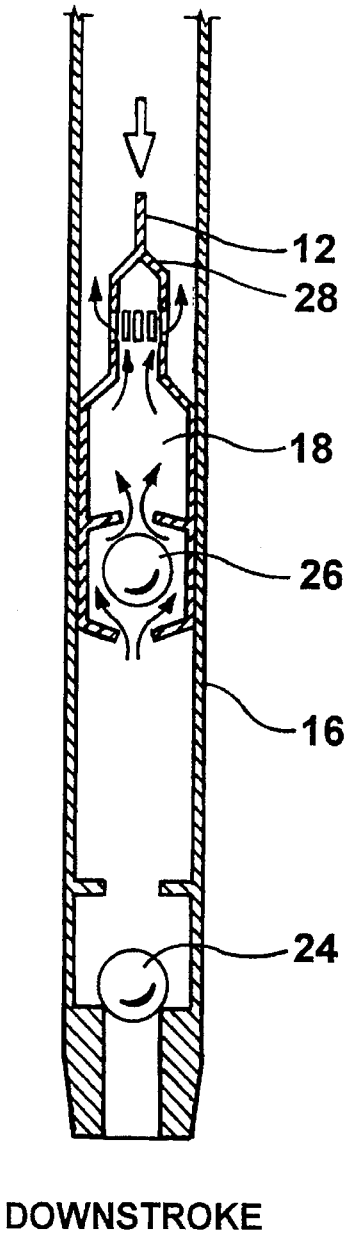
Fig. 3 (PRIOR ART )
FIG. 3 is a diagram showing a typical sucker rod pump of the prior art during a downstroke phase of its cycle of operation.

FIG. 1 shows a typical sucker rod pumping system known in the prior art. A rod string 12 reciprocates up and down to operate the pump 10 that is located at the lower end of the well. The rod string 12 moves within a stationary tubing 14 through which the oil is pumped upward. The cylindrical chamber of the pump, called the pump barrel 16 is attached to the tubing 14 and forms a continuation of it. The rod string 12 is connected to a plunger 18 that is reciprocated up and down within the pump barrel 16. The tubing 14 is contained within a casing 20. Apertures 22 in the lower end of the casing 20 permit oil to flow from the surrounding formation into the space within the casing. The lower end of the pump 10 must extend into the body of oil within the casing. FIGS. 2 and 3 depict the pump 10 of FIG. 1 in greater detail.

With reference to FIGS. 2 and 3, the plunger 18 is moved up and down by the rod string 12 within the pump barrel 16. A so-called standing valve 24 is located at the lower end of the pump barrel 16 and it controls the flow of oil into the pump, allowing oil to flow upward into the pump but seating to prevent the oil from flowing downwardly out of the pump. The plunger 18 includes a traveling valve 26, so called because it moves with the plunger. The plunger 18 is hollow or includes a passage for the oil to flow through it. The traveling valve permits the oil to flow upwardly through the plunger 18 during the downstroke but prevents the oil from flowing downwardly out of the plunger during the upstroke. The upper end 28 of the plunger includes a number of apertures that permit the oil to flow upwardly out of the plunger. For this reason the upper end 28 of the plunger is called the cage.

FIG. 2 shows the positions of the valves during the upstroke phase of the pumping cycle. The standing valve 24 is open permitting oil to flood into the pump barrel, and the traveling valve 26 is closed so that the oil lying above it is lifted by the rod string 12, as indicated by the arrows in FIG. 2.

FIG. 3 shows the downstroke phase of the cycle of operation. During this phase of operation, the standing valve 24 is closed and the plunger moves downward, so that the oil within the pump barrel 16 is forced to flow upwardly through the traveling valve 26 and through the plunger 18, thereby positioning the oil above the plunger, so that it can be lifted on the next upstroke, as indicated by the arrows in FIG. 3.

FIGS. 1–3 show a typical sucker rod pump of the prior art. Typically, the plunger 18 was affixed to the lower end of the rod string 12, and no provision was made for letting the plunger rotate within the pump barrel. This failure to rotate the plunger within the pump barrel had the potential to cause several undesirble consequences. Abrasive materials that had become lodged unevenly between the plunger and the barrel could cause severe localized wear to both the plunger and the barrel. Oil sand could even cause the plunger to become stuck within the barrel. Galling, caused by wear and heat was common on both the plunger and the barrel. In extreme conditions, the rod string could become unscrewed. These are the very conditions that the present invention seeks to prevent.

Figure 4:
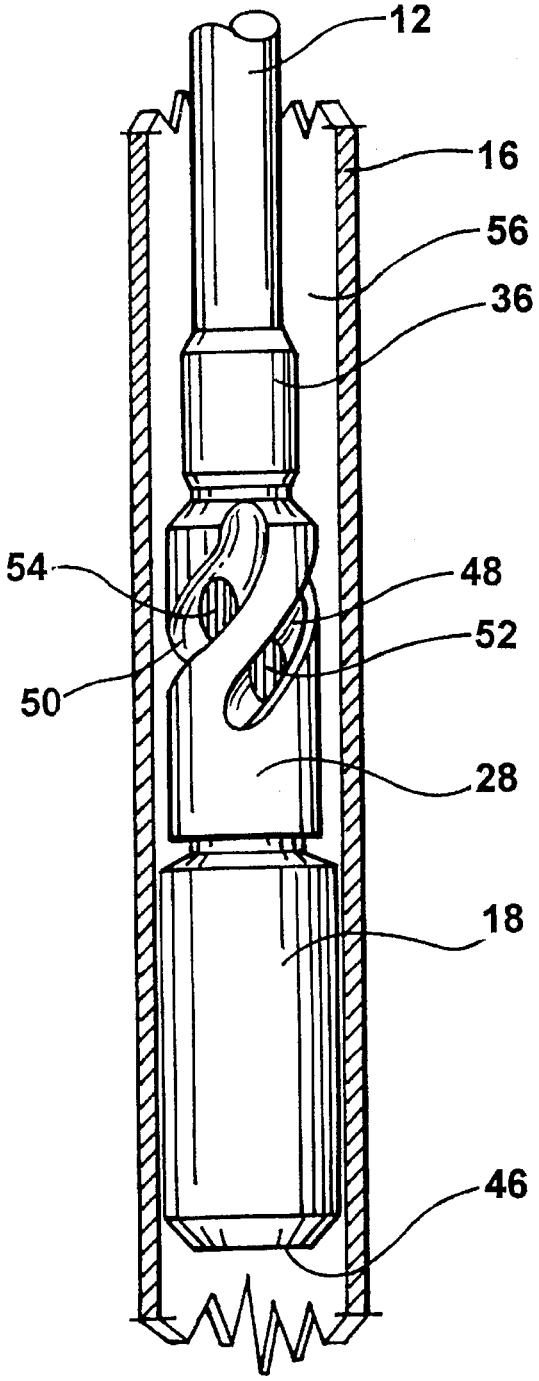
FIG. 4 is a diagram showing a side elevational view of the plunger portion of the sucker rod pump in a first preferred embodiment of the present invention; and, FIG. 5 is a diagram showing a side elevational view of the plunger portion of the sucker rod pump in a second preferred embodiment of the present invention.

FIG. 4 is a diagram showing a side elevational view of the plunger portion of the sucker rod pump in a first preferred embodiment. On the down-stroke, oil enters the plunger 18 through a port 46 that is sealed on the upstroke by the traveling valve 26 (as seen in FIGS. 2 and 3). The oil flows upward through a passage in the plunger 18 into the cage 28 which is thick-walled but hollow. The outside diameter of the cage 28 is appreciably less than the inside diameter of the pump barrel 16. The plunger 18 is rigidly connected to the cage 28. Helical grooves 48 and 50 in the outer surface of the cage 28 communicate with the space inside the cage 28 through the passages 52 and 54 respectively.

On the downward stroke, the oil inside the cage 28 flows out through the passages 52 and 54 into the grooves 48 and 50, and the upward velocity component of the oil reacts against the upper edges of the grooves to produce a torque on the cage 28. In the embodiment of FIG. 4, the torque is in a direction to produce clockwise rotation of the cage and plunger as viewed from above. Rotation of the plunger 18 is desired, but rotation of the rod string 12 is not desired. Therefore, the rod string 12 is attached to the cage 28 by means of a swivel coupling 36. After being discharged from the cage 28, the oil continues to move upward through the space 56 between the swivel coupling 36 and the pump barrel 16 and between the rod string 12 and the pump barrel 16. In this way, on the downstroke, the plunger 18 and the cage 28 rotate, but the rod string 12 does not rotate. The rotation distributes the wear on the plunger 18 more uniformally around the circumference of the plunger, thereby greatly extending the life of the pump. On the upstroke, no oil flows through the plunger 18 and the cage 28, and accordingly, no torque is produced. Therefore, the plunger 18 rotates intermittently during each downstroke.

Figure 5:
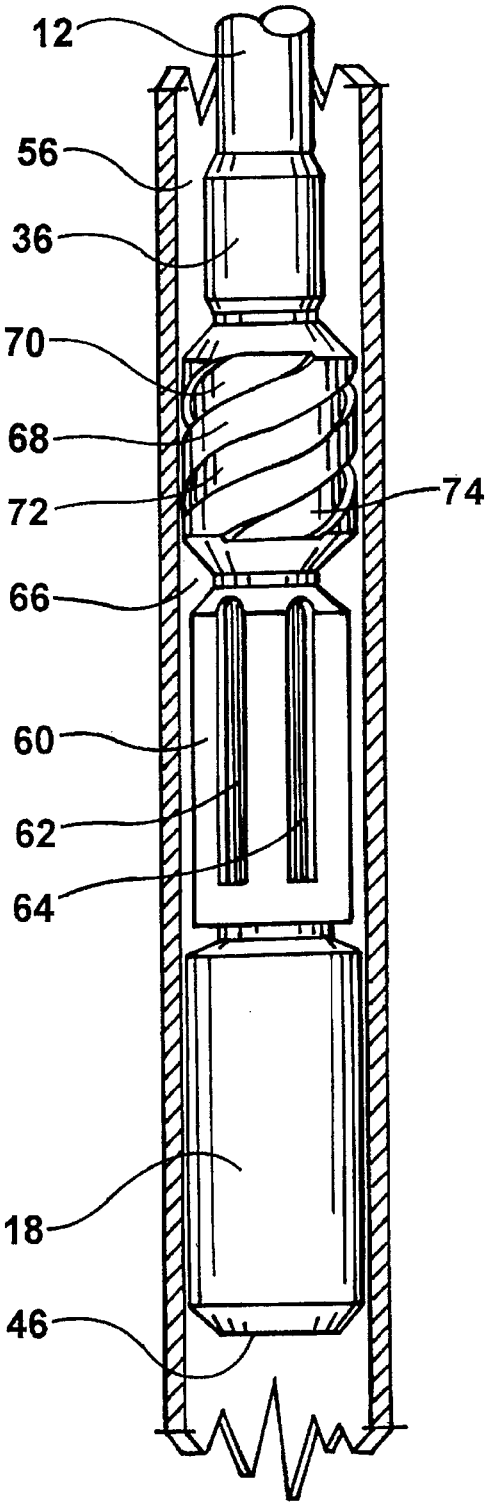

In the second preferred embodiment, shown in FIG. 5, the plunger 18, the swivel coupling 36, the pump barrel 16 and the rod string 12 are the same as in FIG. 4, however the cage 60 and the upper plunger 68 are different. As in the embodiment of FIG. 4, on the downstroke oil enters the port 46 and travels upward through a passage in the plunger 18 into the cage 60. The cage 60 includes apertures 62 and 64 through which the oil flows upwardly and outwardly into the space 66 surrounding the cage 60. The apertures 62 and 64 extend in the axial direction and therefore no torque is produced as the oil flows through the apertures. The upper plunger 68 is rigidly connected to the cage 60, which in turn is rigidly connected to the plunger 18, so that these three elements rotate as a single piece. As the oil travels upward beyond the cage 60 it must past through the helical grooves 70, 72, and 74 in the outer cylindrical surface of the upper plunger 68, which makes a loose sliding fit with the pump barrel 16. The grooves 70, 72, and 74 impart a horizontal velocity component to the oil leaving the upper plunger, and this produces a torque on the upper plunger that urges it to rotate clockwise as seen from above. The upper plunger is rotatably connected to the swivel coupling 36, which permits the upper plunger 68, the cage 60 and the lower plunger 18 to rotate as a unit, without exerting substantial torque on the rod string 12. Rotation of the upper plunger 68 and of the lower plunger 18 serves to distribute wear on these parts more evenly around their circumference.

In both the embodiment of FIG. 4 and the embodiment of FIG. 5, the port 46 is the greatest restriction which the oil encounters on its upward journey. The passages 52 and 54 and the grooves 48 and 50 of FIG. 4 are dimensioned to have considerably greater cross sectional area than the cross sectional area of the port 46. Likewise, in the embodiment of FIG. 5, the apertures 62 and 64 and the grooves 70, 72 and 74 are dimensioned so that their cross sectional area considerably exceeds that of the port 46. From this, the considerable advantage of the present invention over the prior art can be seen. In prior art pumps, the rotation-producing elements, such as vanes, were placed at the lower end of the plunger 18 inside the port 46. This placement of the rotation-producing elements in the most restrictive portion of the pump restricted the flow even more, and there was a tendency for the port to become clogged when pumping sand-bearing oil. In contrast, in the present invention the rotation-producing elements (the cage 28 and the upper plunger 68) are placed well above the plunger 18, where the full inside diameter of the pump barrel 16 is available and where the vertical height of the rotation-producing element is of no concern. In this way, in the present invention the rotation is produced without appreciably restricting the flow of oil, and this produces a multi-fold improvement in the performance of the pump when it is used in thick oil or in oil containing particles of sand or rock.

Thus, there have been described two embodiments of a sucker rod pump that provides superior performance when used for pumping thick or sand-bearing oil.

The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. In a downhole sucker rod pump of a type having a plunger, having a cage affixed to the plunger immediately above the plunger, the plunger and the cage connected to a reciprocating rod string for reciprocation in a generally vertical pump barrel, whereby on a downstroke of the rod string oil enters a port at the bottom of the plunger, flows upwardly through a passage in the plunger and in the cage, and is discharged through an aperture in the cage, the improvement comprising:

rotation-producing means located between the plunger and the rod string in the flow path of the oil, coupled to the plunger, and responsive to the upward how on a downstroke to rotate the cage and the plunger with respect to the pump barrel.

2. The improvement of claim 1 wherein the cage has an outside surface and wherein said rotation-producing means comprise a helical groove extending into the cage from its outside surface and communicating with the passage in the cage, so that in flowing out of the cage the oil passes through the helical groove, thereby producing a torque on the cage and the plunger.

3. The improvement of claim 1 wherein said rotation-producing means comprise an upper plunger located above the cage, affixed to the cage, and having a cylindrical surface adjacent the pump barrel, said upper plunger including a helical groove extending into its cylindrical surface through which helical groove the upwardly-flowing oil must pass, thereby producing a torque on the cage and the plunger.

* * * * *